United States Patent [19]

Drobnik et al.

[11] 4,144,186

[45] Mar. 13, 1979

[54] METHOD AND APPARATUS FOR PROCESSING AQUEOUS RADIOACTIVE WASTES FOR NONCONTAMINATING AND SAFE HANDLING, TRANSPORTING AND FINAL STORAGE

[75] Inventors: Stefan Drobnik, Stutensee-Spöck; Werner Hild, Hochstetten; Friedrich Kaufmann, Karlsruhe; Herbert Koschorke, Stutensee-Friedrichstal, all of Fed. Rep. of Germany

[73] Assignee: Gesellschaft für Kernforschung m.b.H, Karlsruhe, Fed. Rep. of Germany

[21] Appl. No.: 775,288

[22] Filed: Mar. 7, 1977

[30] Foreign Application Priority Data

Mar. 6, 1976 [DE] Fed. Rep. of Germany ..... 2609299

[51] Int. Cl.[2] ..... G21F 9/14; G21F 9/16

[52] U.S. Cl. ..... 422/159; 252/301.1 W; 65/142

[58] Field of Search ..... 252/301.1 W, 301.15

[56] References Cited

U.S. PATENT DOCUMENTS

| | | | |
|---|---|---|---|
| 3,101,258 | 8/1963 | Johnson | 252/301.1 W |
| 3,673,086 | 6/1972 | Drobnik | 252/301.1 W |
| 3,862,296 | 1/1975 | Dotson et al. | 252/301.1 W |

FOREIGN PATENT DOCUMENTS

| | | | |
|---|---|---|---|
| 837967 | 6/1960 | United Kingdom | 252/301.1 W |

OTHER PUBLICATIONS

Krause, H., "Die Verfestigung hochradioactiver Abfalle," Chemie-Ing.-Techn., vol. 45, No. 10a (May, 1973), pp. 648-663.

*Primary Examiner*—Benjamin R. Padgett
*Assistant Examiner*—Deborah L. Kyle
*Attorney, Agent, or Firm*—Spencer & Kaye

[57] ABSTRACT

A method for processing aqueous radioactive wastes for noncontaminating and safe handling, transport and final storage wherein nitric acid and/or nitrate containing aqueous radioactive waste solutions are continuously denitrated with formic acid, spray-dried and calcinated in a spray dryer having a spray nozzle surrounded by a reaction chamber, the resulting calcinate is mixed with glass former substances, the mixture is melted and the melt is caused to solidify into a glass, glass ceramic or glass ceramic-like block and the waste gases produced during denitration-drying and calcination are conducted through a filter system in order to remove solid particles that have been carried along by the gas. The process steps of denitration, drying and calcination are effected simultaneously and are terminated with the aid of and the intimate energy exchange in the fine distribute droplets superheated steam in the vicinity of the spray nozzle. The resulting waste gases are cleaned within a filter chamber surrounding the reaction chamber with the spray nozzle. An apparatus is provided for practicing the method.

9 Claims, 2 Drawing Figures

METHOD AND APPARATUS FOR PROCESSING AQUEOUS RADIOACTIVE WASTES FOR NONCONTAMINATING AND SAFE HANDLING, TRANSPORTING AND FINAL STORAGE

BACKGROUND OF THE INVENTION

The present invention relates to a method and apparatus for processing aqueous, radioactive wastes for noncontaminating and safe handling, transporting and final storage in which aqueous radioactive waste solutions containing nitric acid and/or nitrates are continuously denitrated with formic acid, and are spray-dried and calcinated. The resulting calcinate is mixed with glass former substances, the mixture is melted and the melt is caused to solidify into a glass, glass ceramic or glass ceramic-like block, and the waste gases produced during denitration, drying and calcination are conducted through a filter system in order to remove solid particles that have been carried along with the gas.

For safe handling, transport and storage of radioactive wastes, particularly if they are to be stored over long periods of time, only those solidification products can be used which have high chemical, mechanical and radiolytic stability. Solidification products containing highly radioactive wastes must also have a high thermal stability. A suitable solidification matrix for such wastes has been found to be borosilicate glasses which are also encountered in nature at an age up to $10^5$ years. These glasses are capable of absorbing large amounts of fission product oxides and corrosion products from the wastes with a simultaneous relatively great insensitivity with respect to the particular composition of the fission product oxides and corrosion products.

During the melting process for solidification of the wastes, complete homogenization must take place during their stay in the melting crucible. Since sufficient stability of the material from which the metallic melting crucible is made is assured only up to about 1200° C., this temperature constitutes an upper limit for the temperature of the solidification melt. On the other hand, a viscosity of less than 100 poise is required. This requirement is a result of the configuration of the melt outlet so that the flow of glass can be interrupted by cooling.

The softening point ($10^8$ poise) of glass solidification products must lie, for reasons of later storage, for example, storage in rock salt, above 700° C. Experimental melts using simulated, i.e., inactive, fission product oxide mixtures have shown that, for the incorporation of radioactive fission product oxide mixtures and other solid mixtures of radioactive wastes in quantities up to 25 percent by weight of the solidification product, a basic glass type, having a composition, in percent by weight of the basic glass, of 52.5% $SiO_2$, 10.0% $TiO_2$, 2.5% $Al_2O_3$, 10.0% $B_2O_3$, 5.0% CaO and 20.0% $Na_2O$, can be used with advantage as a glass frit which is mixed with the radioactive mixtures to form the melt.

A typical aqueous radioactive waste which is incorporated into a borosilicate glass matrix is the highly active nitric acid containing waste solution (HAW) which is obtained during reprocessing of irradiated nuclear fuel and/or breeder materials after the common extraction of uranium and plutonium in the first cycle of an extraction process. A concentrate (1 WW) is obtained by evaporation and simultaneous partial decomposition of the excess HAW solution, and, if this 1 WW concentrate is to be solidified after intermediate storage, it is necessary to initially practically completely denitrate it, preferably with formic acid.

According to a process of W. Guber et al, as described in "Symposium on the Management of Radioactive Wastes From Fuel Reprocessing"; Proceedings of a Symposium organized jointly by the OECD Nuclear Energy Agency and the International Atomic Energy Agency, OECD, Paris; Nov. 27th to Dec. 1st, 1972, Organization for Economic Cooperation and Development, Paris, Mar., 1973, pages 489 to 512, the denitration with formic acid is effected continuously or in batches in a separate denitrator.

The free nitric acid and the nitrates of the transition metals are destroyed in this denitration process. Thus, with a pH of about 2, most of the transition elements are present in the denitrated 1 WW concentrate as difficultly soluble oxides, hydroxides, formiates, etc., and the noble metals are present in elemental form.

Gaseous reaction products are formed during the denitration process, and these gaseous products include $CO_2$, $N_2O$ and traces of $N_2$ and NO. It is the aim of the denitration process to reduce corrosion by nitrous gases and their secondary products and not to charge the waste gases with nitrous gases. A further aim of the denitration process is to drastically reduce the ruthenium volatility of the easily volatile $RuO_4$ produced in the oxidizing environment during the subsequent high temperature stages. The denitrated 1 WW solution is dried in a separate spray calcinator and is substantially calcinated, separated in a likewise separate filter tower, and transferred to the melting stage. The resulting calcinate is mixed with measured quantities of solid glass components, i.e., a mixture of glass forming substances or a prefabricated granulated basic glass, respectively, and is melted in a melting crucible. Depending on the fill level in the crucible, its discharge opening, which is closed by a glass plug, is melted open from time to time, so that the glass melt can be transferred to a chill mold.

The waste gases from the spray calcinator are cleaned a first time over sinter metal filter cartridges or candles and are freed of solids, the total decontamination factor being about $10^4$.

This previously-reported procedure of W. Guber et al has a number of drawbacks. The process is complicated and expensive with respect to time and personnel. Seen purely theoretically, a denitrator explosion cannot be completely excluded. Such a highly unlikely accident could occur theoretically if, for example, the reaction were stopped, but the feeder solution would continue to be measured in and the heating system would simultaneously malfunction and then, with uncontrolled return of the heat, an explosion-like exothermal reaction would start.

S. Drobnik has examined the possibility of performing the steps of denitration, spray drying and calcination continuously in one process stage, as reported at pages 37 to 40 of "Jahresbericht 1970 — Abteilung Dekontaminationsbetriebe; Bericht der Gesellschaft für Kernforshung mbH" (in translation, Annual Report for 1970 — Department of Decontamination Operations; Report of the Gesellschaft für Kernforschung m.b.H.), Karlsruhe No. KFK-1500 (June, 1972). For this purpose, an electrically heatable stainless steel pipe of 3 m in height and 70 mm diameter and equipped at its upper end with a spray nozzle was used to carry a simulated inactive, nitric acid fission product solution and formic acid which were fed in through the nozzle. Helium was introduced as the driving gas in order to facilitate the subsequent gas chromatographic examination of the waste gases. After passage through the spray dryer, the dried product was separated in a cyclone and the vapors were condensed in a cooler. The apparatus employed for these experiments was of the type with small throughput (laboratory equipment). In each experiment, 250 l of a model solution, which was 5.2 molar for hydrogen ions and about 7.1 molar for nitrate ions, and a 98% formic acid with a mole ratio of HCOOH: $H^+$ of 2.55 were measured at a speed of about 5 ml per minute into the spray chamber which had been heated to 500° C. The throughput for helium was 18 l/h. The dried product reached a temperature of 220° to 300° C. It was found that the reaction of the formic acid with the nitric acid and part of the nitrates takes place in the upper portion of the apparatus. In the lower portion, the remaining nitrates decompose to oxides and nitrous gases which themselves are reduced to $N_2$, $N_2O$ and NO by excess formic acid. Volatilization of ruthenium could never be proved.

This previously-reported process of S. Drobnik is also complicated and time consuming. The stainless steel pipe which is heated externally permits only a limited throughput of waste solution.

SUMMARY OF THE INVENTION

It is an object of the present invention to provide a safe process for the solidification of aqueous, radioactive wastes in glass, glass ceramic or glass ceramic-like material.

A further object of the present invention is to provide such a process which reduces the susceptibility of the system to malfunction even for large throughputs and thus increases operational safety and thereby improves the safety factor regarding radiation passing into the environment.

Another object of the present invention is to provide a process in which the calcination of the waste and the melting of the calcinate with glass frits or glass formers into a melt of the solidification product takes place without problems in a relatively small, compact apparatus.

A still further object of the present invention is to provide an apparatus for practicing the method.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention, as embodied and broadly described, provides a method for processing aqueous radioactive wastes for noncontaminating and safe handling, transport and final storage wherein nitric acid and/or nitrate containing aqueous radioactive waste solutions are continuously denitrated with formic acid, spray-dried and calcinated in a spray dryer having a spray nozzle which forms fine distributed droplets and which is surrounded by a reaction chamber, the resulting calcinate is mixed with glass former substances, the mixture is melted and the melt is caused to solidify into a glass, glass ceramic or glass ceramic-like block and the waste gases produced during denitration, drying and calcination are conducted through a filter system in order to remove solid particles that have been carried along by the gas, which comprises simultaneously effecting the process steps of denitration, drying and calcination terminating these process steps with the aid of superheated steam and an intimate energy exchange between the fine distributed droplets in the vicinity of the spray nozzle, and cleaning the resulting waste gases within a filter chamber which surrounds the reaction chamber.

An advantageous embodiment of the apparatus according to the present invention for practicing the method of the present invention comprises a downwardly open vessel which is provided in its interior with a spray nozzle. The vessel further includes a filter system arranged about the spray nozzle, a metering device for metering out glass frits or glass former substances, a steam inlet for introducing circulating steam into the interior of the vessel, a steam inlet for introducing rinsing steam into the filter system, and a waste gas outlet connected to the filter system. A heatable melting crucible having a heatable outlet stud and a heatable sample-taking device is disposed below the vessel and is releasably connected therewith. A heatable chill mold carrier for interchangeable chill molds which accommodate the melt charges is disposed below the melting crucible.

The spray nozzle preferably is equipped with an inlet for the formic acid and with an inlet for atomization steam and is provided with an inlet and an outlet for a coolant in the area of its lower end.

In one embodiment of the apparatus according to the present invention, the spray nozzle is disposed in the lower part of the vessel. In such case, the filter system which is arranged around the spray nozzle is protected against heat radiation from the nearby surface of the melt in the melting crucible by a protective baffle arranged below the filter system.

In another embodiment of the apparatus according to the present invention, the spray nozzle is arranged in the upper portion of the vessel, and the vessel is provided with abutment sheets in the area between the spray nozzle and the filter system. The filter system includes a plurality of filter cartridges or candles and is advantageously arranged within the double walls of the vessel which are open toward the interior of the vessel at the bottom of the vessel.

The process and apparatus according to the invention have a number of advantages over the prior art methods and apparatuses. A denitrator explosion, which could not be completely excluded for the prior art methods and apparatuses under theoretical considerations (as they are used in the nuclear energy law authorization procedures for nuclear engineering systems), is dependably avoided by the present invention. In the closed denitrator of the prior art, if the denitration reaction in the aqueous phase is delayed due to a drop in the temperature of the liquid to below 60° C. to 70° C. and becomes irregular, it is possible that, with further introduction of feeder solution and with a malfunctioning heating system, a sudden, violent reaction will take place if the temperature is uncontrolled and again exceeds the above threshold. Such an accident is impossible in the process according to the present invention because the denitration reaction does not take place in the liquid phase but in the gaseous phase at about 400° C., and thus is at once complete and can be safely terminated within a small reaction chamber.

Moreover, in the process according to the present invention, the previously-required analysis to control the denitrating solution before it is fed into the spray nozzle is eliminated, and the possibly required preconcentration of the denitrated solution is likewise eliminated.

Furthermore, the present invention decreases the size of the dust zone and relieves the waste gas filtering system. This makes it possible to operate with higher throughputs. The process of the present invention is thus more favorable with respect to the expenditures of time, personnel and money.

The apparatus according to the invention is compact, can easily be controlled, and can be set up in smaller hot cells. Thus, a reduction in space requirements and costs for the hot cells for highly active work can also be noted. In addition, the effect on the environment is more favorable since the exhaust gas has a more favorable composition and occurs in smaller quantities. Further, with the apparatus of the present invention, it is always possible without difficulties to obtain samples in various quantities to control the melt through the heatable sample-taking device.

It is to be understood that both the foregoing general description and the following detailed description are exemplary, but are not restrictive of the invention.

BRIEF DESCRIPTION OF THE DRAWINGS

The accompanying drawings, in which like numbers indicate like parts, illustrate examples of presently preferred embodiments of the invention and, together with the description, serve to explain the principles of the invention.

Of the drawings.

DETAILED DESCRIPTION OF THE INVENTION

Figure 1:
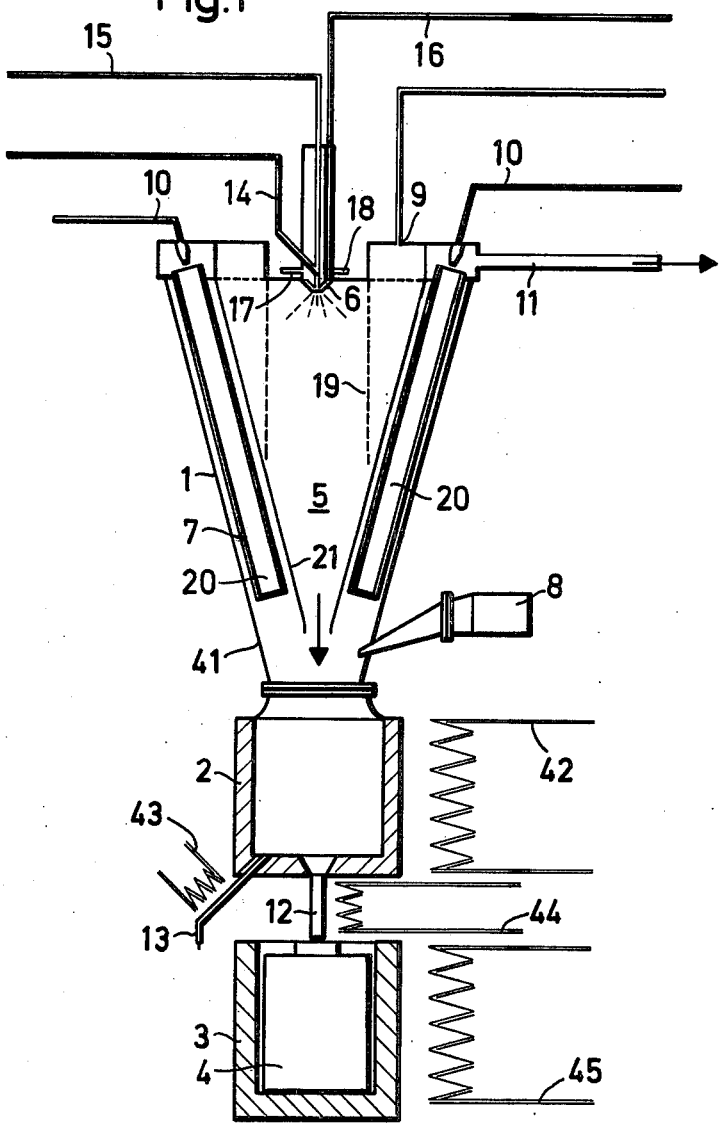
FIG. 1 is a schematic representation of an embodiment of an apparatus according to the teachings of the present invention in which a spray nozzle is disposed in the upper portion of a vessel.

Referring to FIG. 1, there is shown an apparatus for practicing the method of the present invention, which apparatus includes a downwardly open vessel 1. Vessel 1 has a downwardly tapered, conical shape with hollow double walls. The double walls of vessel 1 include an inner wall 21 and an outer wall 41. The inner wall 21 of the double walls of vessel 1 is open toward the interior 5 of vessel 1 at the bottom of vessel 1. A spray nozzle 6 is disposed in the interior 5 of vessel 1 in the upper portion of the vessel, such as in the upper one-third of interior 5. Spray nozzle 6 is provided with an inlet 14 for a waste solution to be treated, with an inlet 15 for formic acid, and with an inlet 16 for atomizer steam. Spray nozzle 6 further includes in the area of its lower end an inlet 17 and an outlet 18 for a coolant, such as, for example, water. A steam inlet 9 is provided at the top of vessel 1 to introduce circulating steam into the interior of vessel 1 and convey the atomized solution which leaves nozzle 6 downwardly through vessel 1.

A filter system 7 for cleaning the waste gases formed during the denitration and calcination is arranged around spray nozzle 6. Filter system 7 includes a plurality of filter cartridges or candles 20 which are disposed in the double walls of the vessel. Filter candles 20 lead into a waste gas outlet 11 at the upper portion of vessel 1. A steam inlet 10 is provided adjacent the top of each filter candle 20 for introducing steam into the filter candles to rinse the filter candles if they become clogged. Perforated abutment sheets 19 of metal are provided between spray nozzle 6 and filter system 7. A metering device 8 to measure out glass frits or glass former substances is disposed in the lower portion of vessel 1.

The apparatus further includes a heatable melting crucible 2, which is releasably connected with the bottom of vessel 1. A heating element 42 adjacent melting crucible 2 serves to heat the melting crucible. Melting crucible 2 is provided at its bottom portion with a heatable outlet stud 12 and a heatable sample-taking device 13. Sample-taking device 13 can be in the form of a tube and a heating element 43 adjacent the tube serves to heat the tube. Similarly, a heating element 44 adjacent outlet stud 12 serves to heat the outlet stud. A heatable chill mold carrier 3 is disposed below melting crucible 2 to accommodate a chill mold 4. A heating element 45 adjacent chill mold carrier 3 serves to heat the chill mold carrier.

Figure 2:
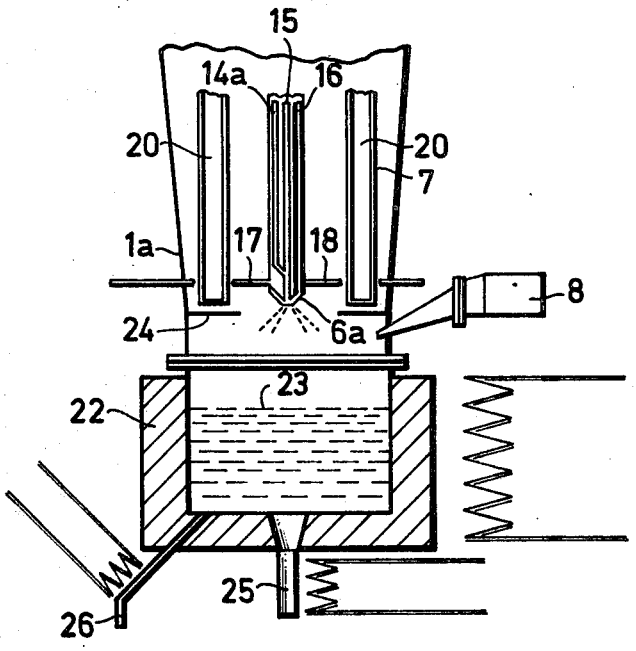
FIG. 2 is a schematic representation of a part of an apparatus according to the embodiment of the present invention where a spray nozzle is arranged in the lower portion of a vessel.

Turning now to FIG. 2, there is shown a downwardly open vessel 1*a* which has a spray nozzle 6*a* disposed in the lower portion of the interior of vessel 1*a*. Spray nozzle 6*a* is provided with an inlet 14*a* for a waste solution to be treated, with an inlet 15 for formic acid, and with an inlet 16 for atomizer steam. Spray nozzle 6*a* further includes, in the area of its lower end, an inlet 17 and an outlet 18 for a coolant. Vessel 1*a* has only a single wall and is connected with a ceramic crucible or melting furnace 22, respectively, which accommodates a melt having a melting surface 23. Vessel 1*a* has a larger diameter of 450 mm than vessel 1 with 330 mm of FIG. 1 and its walls are only slightly conical, and these factors permit vertical arrangement of filter system 7 with its filter candles 20 within vessel 1*a*. Filter system 7 in FIG. 2 is shielded against the overly strong stress from the heat radiation from the melt surface 23 by means of a protective baffle 24 which is disposed below the filter system. Ceramic melting crucible 22 contains an outlet stud 25 and a sample-taking device 26.

The following example is given by way of illustration to further explain the principles of the invention. This example is merely illustrative and is not to be understood as limiting the scope and underlying principles of the invention in any way. All percentages referred to herein are by weight unless otherwise indicated.

EXAMPLE

A 1 WW solution is introduced into spray nozzle 6 or 6*a* through inlet line 14 or 14*a*, respectively, at a flow rate of 6.5 to 30 l/h. Simultaneously with the introduction of the 1 WW solution, 1 to 12 l/h of 98% formic acid is introduced through inlet line 15 into spray nozzle 6 or 6*a*, respectively, and atomizing steam is introduced through line 16 into spray nozzle 6 or 6*a*, respectively. The atomizing superheated steam is introduced at a temperature of 250° to 300° C. and a pressure of 3 bar and with a throughput of 8 to 30 kg/h. Spray nozzle 6 or 6*a*, respectively, is cooled by a coolant, e.g., water, in order to reduce corrosion and clogging of the nozzle. The water for this cooling is introduced into nozzle 6 or 6*a* through inlet 17 and extracted through outlet 18. Since spray nozzle 6 or 6*a* is being cooled by the coolant, inlet 16 for the atomization steam is provided with a thermal insulation in the area of spray nozzle 6 or 6*a*, respectively. Circulating superheated steam of 600° to 650° C. in quantities between 200 and 350 kg/h is introduced with a pressure at 1.2 bar into vessel 1 through steam inlet 9 to provide a conveying means for conveying the atomized solution through the vessel. By using vessels 1*a* circulating steam is not necessary because most of the drying energy is provided by temperature radiation of the inner walls. Due to the exothermal reaction of the nitrate ions with the formic acid and the addition of the circulating steam through steam inlet 9, the interior 5 of vessel 1 or 1*a* is heated to about 420° to 450° C. in the vicinity of the spray nozzle 6 or 6*a*, respectively. As a result of this heating, the 1 WW solution is denitrated, dried and the dried substance is calcinated even before it leaves the immediate vicinity of spray nozzle 6 or 6*a*, respectively.

For the case where a vessel 1 is employed which has a downwardly tapered, conical shape with hollow double walls and the spray nozzle 6 is arranged in its upper portion, as in FIG. 1, the descending calcinate still has a temperature of about 420° C. in the area of the glass frit or glass former metering device 8. With a spray pressure of 3 atmospheres gauge, an operating temperature of 420° C. must be maintained to keep the walls of vessel 1 from growing shut. The perforated abutment sheets 19 which are disposed between the spray nozzle 6 and the inner wall 21 of the vessel 1 aid in preventing the walls of vessel 1 from growing shut. Before they leave vessel 1, waste gases containing the nitrate decomposition products, etc., and coming from spray nozzle 6 are initially conducted downwardly with the circulating steam and with the calcinate, are then separated from the calcinate in the lower portion of vessel 1, and are redirected in an upward direction through filter candles 20 of filter system 7 disposed in the double walls of vessel 1 to leave vessel 1 through waste gas outlet 11.

The calcinate, together with a quantity of glass frit or glass former substances corresponding to 100 to 200 g per liter of the 1 WW feeder solution, drops into melting crucible 2 which has been heated to a temperature of about 1150° C. Melting crucible 2 in this case may be a metal melting furnace made, for example, of Inconel. During the melting process — at least three hours are required to obtain a homogeneous mass — the outlet stud 12 and the sample-taking device 13, which essentially is a heatable, thin tube, are not heated or not heated to such an extent, respectively, that melt can flow therethrough. In order to take a sample, the sample-taking device 13 is heated by heating element 43 so that the melt can exit in drops. Approximately the first 10 drops are discarded and the next drops are caught and examined. After the heating element 43 has been shut off, a plug forms which reseals sample-taking device 13. If examination of the sample taken from sample-taking device 13 shows that the melt is homogeneous, outlet stud 12 is then heated by heating element 44 to such a temperature that the melt can flow through it into a chill mold 4 which is disposed in chill mold carrier 3. By heating chill mold carrier 3 by heating element 45, the solidification product is kept at 700° C. for at least two more hours and is tempered.

In the case where the apparatus according to the invention is designed as shown in part in FIG. 2, approximately the five-fold throughput with respect to that which can be obtained in FIG. 1 can be realized.

The use of a ceramic melting crucible 22 in FIG. 2, whose outlet stud 25 and sample-taking device 26 perform the same functions as the corresponding devices 12 and 13 of FIG. 1, permits in respect to metallic crucibles an increase of the temperature of the melt to about 1350° C., and thus faster or better, respectively, mixing of the calcinate with the frit or the glass formers, respectively, and the handling of a larger volume. This results in the possibly significantly increased throughput of solidification products. Potential candidates of ceramic materials for use in the crucible are ceramics based on zirconium silicates or chromium If the filter candles 20 of filter system 7 either in oxides. FIG. 1 or 2 should become clogged, rinsing steam at a temperature of about 350° C. is introduced through steam inlets 10 into the filter candles 20 in a direction opposite to the flow of the gases through the filter candles in quantities of 5 kg per minute and under a pressure of 6 to 9 bar so that filter candles 20 are freed again.

It will be understood that the above description of the present invention is susceptible to various modifications, changes and adaptations, and the same are intended to be comprehended within the meaning and range of equivalents of the appended claims.

What is claimed is:

1. Apparatus for processing aqueous radioactive wastes for noncontaminating and safe handling, transport and final storage wherein nitric acid and/or nitrate containing aqueous radioactive waste solutions are continuously denitrated with formic acid, spray-dried and calcinated, the resulting calcinate is mixed with glass former substances, the mixture is melted and the melt is caused to solidify into a glass, glass ceramic or glass ceramic-like block and the waste gases produced during denitration, drying and calcination are conducted through a filter system in order to remove solid particles that have been carried along by the gas, comprising:

(a) a downwardly open vessel having
  (i) a spray nozzle in its interior, said spray nozzle being provided with an inlet for the waste solution, with an inlet for the formic acid and with an inlet for atomizer steam, and further includes in the area of its lower end an inlet and an outlet for a coolant.
  (ii) a filter system arranged around said spray nozzle,
  (iii) a metering device to measure out glass frits or glass former substances,
  (iv) a steam inlet for introducing rinsing steam into the filter system, and
  (v) a waste gas outlet connected to the filter system;
(b) a heatable melting crucible disposed below and releasably connected with said vessel and provided with a heatable outlet stud and a heatable sample-taking device; and
(c) a heatable chill mold carrier disposed below the melting crucible to accommodate a chill mold.

2. Apparatus as defined in claim 1, wherein the spray nozzle is disposed in the lower portion of the vessel.

3. Apparatus as defined in claim 2, wherein a protective baffle is disposed below the filter system in order to protect the filter system against heat radiation from the nearby surface of the melt in the melting crucible.

4. Apparatus as defined in claim 1, wherein the spray nozzle is disposed in the upper portion of the vessel and the vessel is provided with abutment sheets between the spray nozzle and the filter system.

5. Apparatus as defined in claim 1, wherein the vessel has double walls, the filter system comprises a plurality of filter candles and said filter candles are disposed within the double walls of the vessel, said walls being open toward the interior of the vessel at the bottom of the vessel.

6. Apparatus as defined in claim 5, wherein the spray nozzle is disposed in the upper portion of the vessel and the vessel is provided with abutment sheets between the spray nozzle and the filter system.

7. Apparatus as defined in claim 1, wherein the vessel has a steam inlet for introducing circulating superheated steam into the interior of the vessel.

8. Apparatus for processing aqueous radioactive wastes for noncontaminating and safe handling, transport and final storage, wherein nitric acid and/or nitrate containing aqueous radioactive waste solutions are continuously denitrated with formic acid, spray-dried and calcinated, the resulting calcinate is mixed with glass former substances, the mixture is melted and the melt is caused to solidify into a glass, glass ceramic or glass ceramic-like block and the waste gases produced during denitration, drying and calcination are conducted through a filter system in order to remove solid particles that have been carried along by the gas, comprising:

(a) a downwardly open vessel having
  (i) a spray nozzle in its interior, and being disposed in the lower portion of the vessel,
  (ii) a filter system arranged around said spray nozzle,
  (iii) a metering device to measure out glass frits or glass former substances,
  (iv) a steam inlet for introducing rinsing steam into the filter system, and
  (v) a waste gas outlet connected to the filter system;
(b) a heatable melting crucible disposed below and releasably connected with said vessel and provided with a heatable outlet stud and a heatable sample-taking device; and
(c) a heatable chill mold carrier disposed below the melting crucible to accommodate a chill mold.

9. Apparatus as defined in claim 8, wherein a protective baffle is disposed below the filter system in order to protect the filter system against heat radiation from the nearby surface of the melt in the melting crucible.

* * * * *